US009074587B2

(12) United States Patent
Atchia

(10) Patent No.: US 9,074,587 B2
(45) Date of Patent: Jul. 7, 2015

(54) ENERGY EFFICIENT SEWAGE PUMPING SYSTEM WITH A CONTROLLER AND VARIABLE FREQUENCY DRIVE AND METHOD

(75) Inventor: Alain Julian Atchia, Tarpon Springs, FL (US)

(73) Assignee: SJE-Rhombus, Detroit Lakes, MN (US)

( * ) Notice: Subject to any disclaimer, the term of this patent is extended or adjusted under 35 U.S.C. 154(b) by 150 days.

(21) Appl. No.: 13/548,500

(22) Filed: Jul. 13, 2012

(65) Prior Publication Data

US 2013/0022475 A1 Jan. 24, 2013

Related U.S. Application Data

(60) Provisional application No. 61/509,020, filed on Jul. 18, 2011.

(51) Int. Cl.

| | |
|---|---|
| ***F04B 23/02*** | (2006.01) |
| ***F04B 49/06*** | (2006.01) |
| ***F04D 13/08*** | (2006.01) |
| ***F04D 15/00*** | (2006.01) |
| ***F04D 27/00*** | (2006.01) |

(52) U.S. Cl.

CPC ..... *F04B 23/021* (2013.01); *F04B 49/065* (2013.01); *F04B 49/06* (2013.01); *F04D 27/004* (2013.01); *F04D 15/0066* (2013.01); *F04D 13/086* (2013.01); *F04D 13/08* (2013.01); *F04B 23/023* (2013.01)

(58) Field of Classification Search

CPC F04D 15/0218; F04D 15/0066; F04B 49/065

USPC ..... 417/53, 36; 700/282

See application file for complete search history.

(56) References Cited

U.S. PATENT DOCUMENTS

| | | | | |
|---|---|---|---|---|
| 6,443,005 | B1 | 9/2002 | Chandler, Jr. | |
| 6,595,051 | B1 | 7/2003 | Chandler, Jr. | |
| 7,075,443 | B1 | 7/2006 | Chandler, Jr. | |
| 7,224,283 | B1 * | 5/2007 | Chandler et al. | 340/618 |
| 2007/0114162 | A1 * | 5/2007 | Stiles et al. | 210/137 |
| 2008/0247880 | A1 * | 10/2008 | Leuthen et al. | 417/44.11 |

(Continued)

OTHER PUBLICATIONS

PID Controller, Apr. 14, 2014, Wikipedia, p. 14.*

(Continued)

*Primary Examiner* — Alexander Comley
*Assistant Examiner* — Christopher Brunjes
(74) *Attorney, Agent, or Firm* — Brett A. Schenck; Walker & Jocke

(57) ABSTRACT

A system includes a pump that is operative to move liquid out of a reservoir. The system also includes a depth level sensor that is operative to determine a depth level of the liquid in the reservoir, and a controller operatively connected to the depth level sensor. The system further includes a variable frequency drive operatively connected to the motor and the controller. Responsive to the determined depth level of the liquid increasing to a first level, the controller is operative to start operation of the motor. The variable frequency drive is operative to control the speed of the motor. The controller is operative to cause the variable frequency drive to output an optimum frequency that causes the motor to operate at substantially the lowest usage of energy to lower the depth level of the liquid in the reservoir from the first level to a second level.

13 Claims, 2 Drawing Sheets

(56) References Cited

U.S. PATENT DOCUMENTS

2008/0288115 A1* 11/2008 Rusnak et al. ..... 700/282
2012/0100014 A1* 4/2012 Seitter ..... 417/53

OTHER PUBLICATIONS

PID Controller PDF.*
PID Controller.*

* cited by examiner

ENERGY EFFICIENT SEWAGE PUMPING SYSTEM WITH A CONTROLLER AND VARIABLE FREQUENCY DRIVE AND METHOD

CROSS-REFERENCE TO RELATED APPLICATIONS

This application claims benefit under 35 U.S.C. §119(e) of Provisional Application No. 61/509,020 filed Jul. 18, 2011, the disclosure of which is incorporated herein by reference in its entirety.

BACKGROUND

The present invention relates to systems that control levels of liquids in reservoirs. Specifically this invention relates to liquid level sensing and control systems for wastewater systems.

It is often desirable to know information about liquid levels in tanks. Determining liquid levels and controlling liquid levels in reservoirs, such as in sewage tanks, wells, water cisterns or tanks, and other liquid systems and storage vessels, whether enclosed or open and exposed to the environment, has been done in a number of ways. For example, in tanks that are visually accessible, an operator may periodically take visual readings of the liquid level.

Visual readings, however, are often not desirable in systems where an automatic response is required when the liquid level reaches a certain threshold. In such cases the activation of a pump or valve may be necessary to move more liquid into the tanks or to discharge liquid from the tank. In systems where visual readings are not available or when an immediate response is required, control systems are typically employed that are responsive to a liquid level indication. These control systems may benefit from improvements.

Examples of liquid level sensing devices for use with wastewater reservoirs or other liquid holding vessels or tanks are discussed in U.S. Pat. No. 6,595,051 of Jul. 22, 2003; U.S. Pat. No. 6,443,005 of Sep. 3, 2002; U.S. Pat. No. 7,075,443 of Jul. 11, 2006; and U.S. Pat. No. 7,224,283 of May 29, 2007, which are all hereby incorporated by reference herein.

SUMMARY

The following is a brief summary of subject matter that is described in greater detail herein. This summary is not intended to be limiting as to the scope of the claims.

In an exemplary embodiment, a system is provided. The system includes a pump that includes a motor. The pump is operative to move liquid out of a reservoir. The system also includes a depth level sensor that is operative to determine a depth level of the liquid in the reservoir, and at least one controller operatively connected to the depth level sensor. The system further includes a variable frequency drive operatively connected to the motor and the controller. Responsive to the determined depth level of the liquid increasing to at least a first level, the at least one controller is operative to start operation of the motor. The variable frequency drive is operative to control the speed of the motor. The at least one controller is operative to cause the variable frequency drive to output an optimum frequency that causes the motor to operate at substantially the lowest usage of energy to lower the depth level of the liquid in the reservoir from the first level to a second level.

An exemplary method is also provided. The method includes determining that liquid in a reservoir is at a first level, and through operation of at least one controller, causing a pump to operate at substantially the lowest usage of energy to move liquid out of the reservoir from the first level to a second level in response to the liquid being at the first level.

In another aspect of the exemplary embodiment, a computer-readable medium comprising instructions that, when executed by at least one processor is provided to determine that liquid in a reservoir is at a first level, and through operation of at least one controller, causing a pump to operate at substantially the lowest usage of energy to move liquid out of the reservoir from the first level to a second level in response to the liquid being at the first level.

Other aspects will be appreciated upon reading and understanding the attached figures and description.

DETAILED DESCRIPTION

Figure 1:
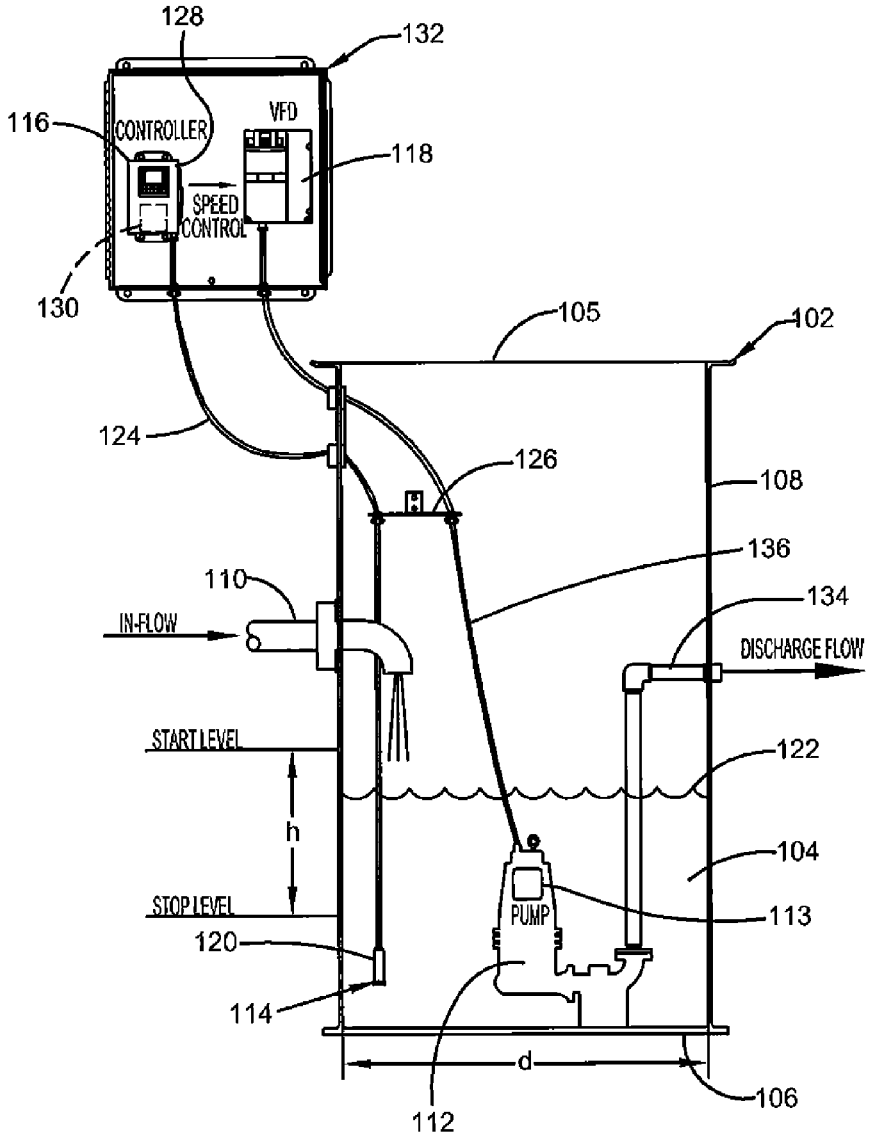
FIG. 1 is a schematic view of an example system that facilitates monitoring and control of a depth level of a liquid in a reservoir.

Various technologies pertaining to an example system that facilitates monitoring and control of a depth level of a liquid in a reservoir will now be described with reference to the drawings, where like reference numerals represent like elements throughout. In addition, several functional block diagrams of example systems are illustrated and described herein for purposes of explanation; however, it is to be understood that functionality that is described as being carried out by certain system components may be performed by multiple components. Similarly, for instance, a component may be configured to perform functionality that is described as being carried out by multiple components.

FIG. 1 shows an exemplary embodiment of a sewage pumping system 100 that facilitates monitoring and control of a depth level of a liquid in a reservoir. The system 100 may include a reservoir 102 capable of holding a liquid 104 therein. Such a liquid may include many different types of fluids and may include solids and semi-solids therein. For example, in a wastewater environment, the reservoir may correspond to a tank that is operative to hold a wastewater liquid including sewage from one or more dwellings. The tank 102 may be cylindrical or any other suitable shape. However, it is to be understood that the described systems may be used in other applications that require a depth level of a liquid to be monitored and adjusted (e.g., wells, cisterns, fountains, ponds, pools, or any other liquid-holding reservoir).

The tank 102 includes a top wall 105, a bottom wall 106, and a side wall 108 that extends between the top and bottom walls 105, 106. An in-flow pipe 110 may extend through an opening in the side wall 108 of the tank or other location in the tank. Sewage flows through the in-flow pipe 110 and into the tank 102. The pumping system 100 may further include a submersible pump 112, a depth level sensor 114, a controller 116 and a variable frequency drive (VFD) 118.

The depth level sensor 114 may be a variety of types. For example, the depth level sensor 114 may comprise a level transducer or differential pressure transmitter 120 that may be an integral sensor and transmitter such as the LevelRat™ transmitter manufactured by Keller America, Inc. This transmitter is loop powered and provides a 4-20 mA signal that is proportional to the level of liquid in the reservoir 102. The transmitter 120 is positioned in the reservoir 102 at a level that is typically below the upper surface level 122 of the liquid 104 in the reservoir 102. The transmitter 120 may be connected to a signal cable 124 that extends out of the liquid 104 and is routed through a support platform 126, which is operatively mounted to the side wall 108 of the tank 102. The signal cable 124 includes a vent tube for atmospheric pressure compensation. The controller 116 may include a control component 128 that is operatively connected to the signal cable 124. The control component 128 may correspond to a processor with appropriate software and/or firmware to cause the processor to carry out the functions of the controller described herein. However, it is to be understood that the control component may correspond to an electrical circuit that does not include software/firmware. Also, the described controller 116 may include one or more processors, and circuits to carry out the functions described herein. The control component 128 is operative to read the 4-20 mA signal emitted by the transmitter 120 and uses the signal in its program logic to determine tank level.

In another exemplary system, the depth level sensor 114 may include an air bell mounted in the reservoir 102 at a level that is typically below the upper surface level 122 of the liquid 104 in the reservoir 102. The air bell may be connected to the cable 124, which in this example is a hollow tube such as a plastic tube that extends out of the liquid 104 and is routed through the support platform 126. Although the air bell includes the word "air", it is to be understood that the air bell and the systems described herein are not limited to use with only air; rather, the air bell may be used with other individual gases or mixtures of gases. The air bell may include additional weight that will prevent the air bell from floating in the liquid 104. The weight may correspond to an outer cylinder that supplies additional mass (which is sufficiently dense) to keep the air bell as low in the reservoir 102 as the tube will permit the air bell to descend. However, in alternative embodiments of the air bell, the air bell may have other shapes and configurations with sufficient mass and density to keep the air bell from floating.

In this example in which the depth level sensor 114 includes the air bell, the controller 116 may include a pressure sensor component 130 in operative connection with the control component 128. The pressure sensor component 130 may be connected to the tube 124 and may be operative to measure the amount of back air pressure in the tube 124. In this example system, the controller 116 may include a common circuit board that includes the control component 128 and the pressure sensor component 130 mounted thereon. In the example system with the differential pressure transmitter 120, the common circuit board need not include the pressure sensor component 130. In either example, the controller circuit board may be mounted within a water resistant housing 132 to form a control panel box. In alternative embodiments in which the depth level sensor 114 includes the air bell, the control component 128 and the pressure sensor component 130 may be mounted separately in the common housing.

In example systems in which the depth level sensor 114 includes the air bell, the pressure sensor component 130 may be a pressure transducer (or other sensor) that is operative to produce electrical signals representative of the current level of pressure in the tube 124. The control component 128 may be programmed and/or otherwise configured to determine a depth level of the liquid 104 in the reservoir 102 responsive to the signals produced by the pressure sensor component 130. In the example system using the air bell as the depth level sensor 114, the control component 128 is operative responsive to the electrical signals from the pressure sensor component 130 (and/or the corresponding determined depth levels of the liquid) to carry out one or more operations. It should be appreciated that in other embodiments other types of depth level sensors may be used in system 100.

The pump 112 is operatively mounted to the bottom wall 106 of the tank 102. A discharge pipe 134 is operatively connected to the outlet of the pump 112 and extends through an opening in the side wall 108 of the tank or other location that extends out of the tank. The discharge pipe 134 is in fluid communication with the pump 112 such that the pump 112 pumps sewage in the tank 102 through the outlet and the discharge pipe. The controller 116 is operatively connected to the variable frequency drive 118. The controller 116 and the variable frequency drive 118 are housed in a housing 132 that is operatively mounted to a structure. The output of the variable frequency drive 118 is electrically coupled to an electric cord 136 that is routed through the support platform 126 and electrically connected to the pump 112.

The pump 112 is operated in response to the depth level sensor 114 as follows. The pump includes an AC motor 113. In operation, the depth level sensor 114 measures or detects the level of sewage in the tank 102. This data is then sent to the controller 116. The controller 116 causes the pump 112 to operate when the depth level sensor 114 detects that the liquid level in the tank 102 has risen above a predetermined pump start level. The controller 116 turns off the pump 112 when the level drops below a predetermined pump stop level. This action is referred to as a pumping cycle. The control component 128 may be programmed or otherwise configured to use a timer to keep track of the length of time that the sewage level in the tank 102 rises from the pump stop level to the pump start level. This is referred to as the fill time. The control component 128 may be programmed or otherwise configured to use the timer to keep track of the length of time that it takes for the sewage level in the tank 102 to fall from the pump start level to the pump stop level during operation of the pump 112. This is referred to as the discharge time.

In this example, the displaced volume of sewage between pump start and pump stop levels is $(\pi\cdot(d/2)^2\cdot h)$ (equation 1), where d is the diameter of the cylindrical tank in feet and h is the distance between the pump stop and start levels in feet. Other volume calculations or formulas may be used for non cylindrical tanks.

Also in this example, the flow in gallons per minute (GPM) of the incoming sewage (inflow) is calculated as follows:

$$(\pi\cdot(d/2)^2\cdot h)\cdot 60\cdot 7.480519/\text{Fill time}.$$

$$(352.51\cdot d^2\cdot h)/(\text{Fill time}). \qquad \text{(equation 2)}$$

The flow of the pump discharge (Discharge Flow) may similarly be calculated as follows:

$$(352.51\cdot d^2\cdot h)/(\text{Discharge time}) \qquad \text{(equation 3)}$$

If the inflow is less than the Discharge Flow, then a Normal inflow condition exists. If the inflow is greater than or equal to the Discharge Flow, then a High inflow condition exists. The flow of the pump discharge with the inflow compensation due to the incoming flow of sewage occurring during the pumping of the sewage may be calculated as follows:

$$\text{Pump GPM}=(352.51\cdot d^2\cdot h)/(\text{Fill time})+(352.51\cdot d^2\cdot h)/(\text{Discharge time}) \qquad \text{(equation 4)},$$

where the flow is in gallons per minute (GPM), d and h are in ft, and fill time is in seconds.

The variable frequency drive 118 is operative to control the motor speed of the motor 113 of the pump 112. The variable frequency drive 118 operates under the principle that the synchronous speed of the AC motor 113 of pump 112 is determined by the frequency of the AC supply and the number of poles in the motor 113. The controller 116 commands the start/stop and frequency output of the variable frequency drive 118.

The speed of the AC motor may be determined by the following equation:

$$RPM=(120\cdot F)/P \quad \text{(equation 5)},$$

where RPM=Revolutions per minute of the rotating magnetic field of the motor (synchronous speed), F=AC power frequency (hertz), and P=Number of poles (an even number).

As discussed previously, the example system may be used in an application that uses a pump 112 to move liquids out of a reservoir 102, such as is done in a wastewater system. Also, the example system may be used in applications that use a valve or pump to move liquids into a reservoir, such as with a fountain, pool, or pond. In such applications, the controller 116 may include a configurable predetermined level corresponding to a liquid add level setting.

The predetermined levels of liquid described herein may have default values stored in software/firmware stored on the controller and/or stored in a memory associated with the control component. Also, the predetermined levels described herein may be configurable values stored in a memory or other devices of the controller that can be configured by users. For example, such values could be configured using input keys, dip switches, or any other input device on or connected to the controller which can provide the control component with information corresponding to desired values for the predetermined levels described herein. Also it is to be understood that some of the described levels, may correspond to the same settings and/or have the same values. For example, the previously described pump stop level setting may correspond to the same configurable setting.

Figure 2:
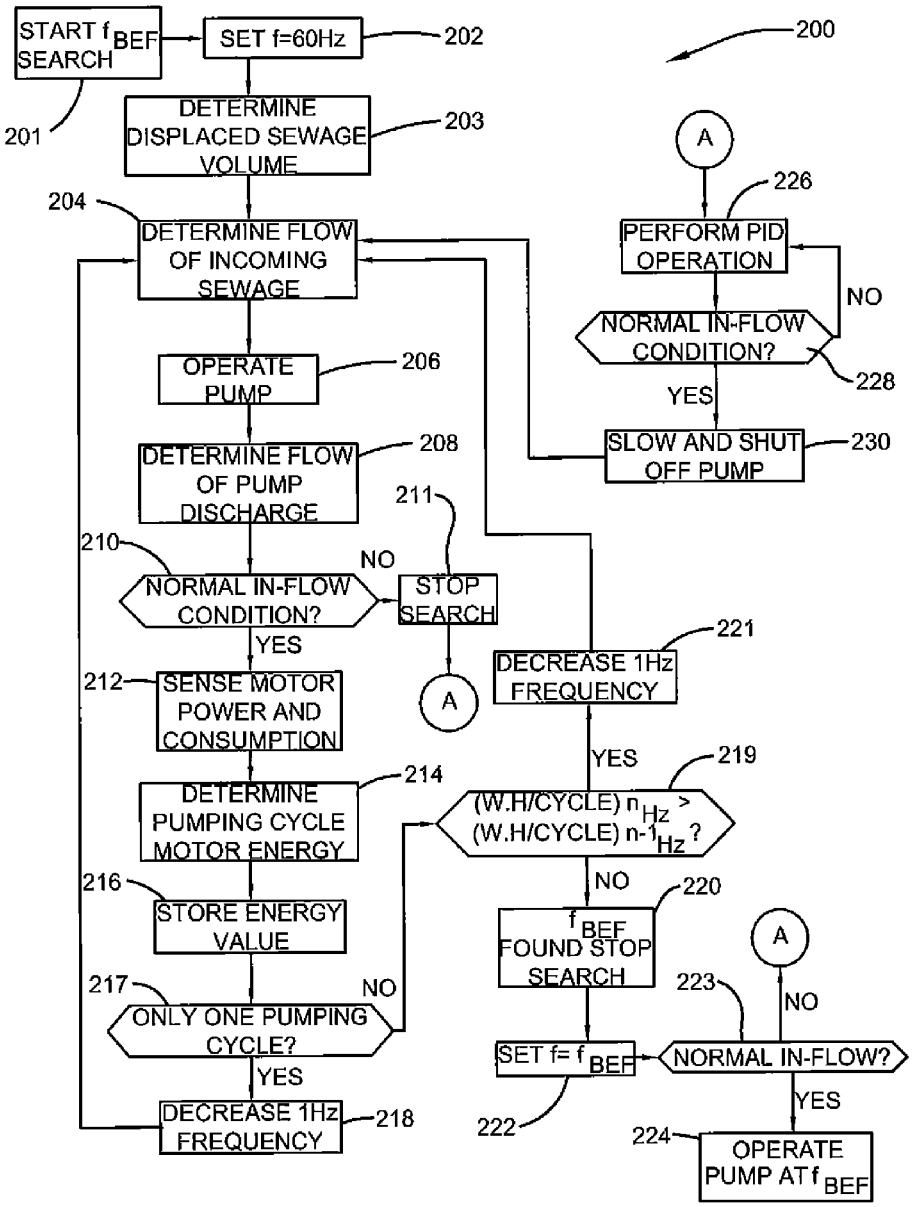
FIG. 2 is a flow diagram that illustrates an example methodology for operating the system of FIG. 1

With reference now to FIG. 2, an example methodology is illustrated and described in which the previously described configuration and calculated data is used to maximize the efficiency of the operation of the pump. While the methodology is described as being a series of acts or steps that are performed in a sequence, it is to be understood that the methodology is not limited by the order of the sequence. For instance, some acts or steps may occur in a different order than what is described herein. In addition, a step may occur concurrently with another step. Furthermore, in some instances, not all steps may be required to implement a methodology described herein.

Moreover, the steps or acts described herein may be computer-executable instructions that can be implemented by one or more processors and/or stored on a computer-readable medium or media. The computer-executable instructions may include a routine, a sub-routine, programs, a thread of execution, and/or the like. Still further, results of acts of the methodology may be stored in a computer-readable medium, displayed on a display device, and/or the like.

FIG. 2 shows an example methodology 200 that finds the output frequency ($f_{BEF}$) of the variable frequency drive 118 that results in a substantially lowest energy usage per pumping cycle. In step 201, the search for the output frequency $f_{BEF}$ is started. In step 202, the output frequency is set at a predetermined value such as 60 hz. In step 203, the displaced volume of sewage between the pump start level and the pump stop level is determined from equation 1 (or other volume formula) using the distance d between the pump start and pump stop levels and the diameter of the cylindrical tank 102. Step 203 may be carried out when the system is being configured or at other times. This step may be manually carried out with the resulting displaced volume data inputted into the controller. Also in some embodiments, the controller may calculate the displaced volume. In step 204, the controller 116 may determine the flow of incoming sewage from equation 2 (or other formula) using the displaced volume and the fill time. In response to the sewage level rising to the pump 112 start level, the controller 116 may cause the variable frequency drive 118 to output a frequency of 60 hz to operate the pump 112 to move liquid out of the reservoir 102 until the depth level drops to the pump stop level. This is represented by step 206. In step 208, the controller 116 then determines the flow of the pump discharge from equation 3 (or other formula) using the determined displaced volume and the discharge time.

In step 210, the controller 116 compares the discharge flow with the inflow to determine whether a normal inflow condition or high inflow condition is present. If the inflow is greater than or equal to the Discharge Flow which is indicative of a High inflow condition, the search for the output frequency $f_{BEF}$ is stopped as represented by step 211. Then, a PID (Proportion, Integral, and Derivative) operation may be carried out as represented by step 226 to determine an optimal frequency to operate the pump. This is explained further in more detail. If the inflow is less than the discharge flow which is indicative of a normal inflow condition, data from the variable frequency drive 118 is used by the controller to measure the power (e.g., in Watts (W)) of the motor 113 for the pump 112 and the power consumption (e.g., in Watt-hour (W·h)) of the motor 113 of the pump 112 at the pump start and stop levels, in step 212. Then, in step 214, the controller 116 determines the energy used in one pumping cycle by subtracting the power consumption of the motor 113 of the pump 112 at the pump start level from the power consumption of the motor 113 of the pump 112 at the pump stop level. In other words, (W·h/Cycle=W·h(pump stop level)−W·h(pump start level)).

The controller 116 then stores the determined energy for the used frequency $(W\cdot h/Cycle)_{60\ Hz}$ in a memory of the controller 116 as represented by step 216. The controller 116 then determines whether there has only been one pump cycle as represented by step 217. This is done by determining whether the output frequency of the variable frequency drive 118 is 60 hz, which is the frequency initially set in step 202. If the controller 116 determines that there has been only one pump cycle, steps 204 to 216 are then repeated for the next pump cycle except that the variable frequency drive 118 is set in step 218 to operate the pump 112 at 1 hertz (or other lower amount) below the previous frequency in which the variable frequency drive 118 was used to operate the pump 112. If the controller 116 determines that there has been more than one pump cycle, the controller 116 compares the current and determined energy amount $(W\cdot h/Cycle)_{59\ Hz}$ with the previous determined energy amount $(W\cdot h/Cycle)_{60\ Hz}$ in step 219. If $(W\cdot h/Cycle)_{59\ Hz}$ is less than $(W\cdot h/Cycle)_{60\ Hz}$, steps 204 to 219 are repeated except that the variable frequency drive 118 is set in step 221 to operate the pump 112 at 1 hertz (or other lower amount) below the previous frequency in which the variable frequency drive last operated the pump 112. In essence, these steps are repeated for as long as the previous determine energy amount $(W\cdot h/Cycle)n_{Hz}$ is greater than the current determined energy amount $(W\cdot h/Cycle)n-1_{Hz}$.

When the previously determined energy amount $(W\cdot h/Cycle)n_{Hz}$ is less than the current determined energy amount $(W\cdot h/Cycle)n-1_{Hz}$, the search for $f_{BEF}$ is stopped as represented by step 220. Then, in step 222, the controller 116 sets the output frequency ($f_{BEF}$) to be that frequency that produced the lowest W·h/Cycle value. Then, in step 223, the controller 116 compares the discharge flow with the inflow to determine whether a normal inflow condition or high inflow condition is present. If the inflow is less than the discharge flow which is indicative of a normal inflow condition, the controller 116 causes the variable frequency drive 118 to operate the pump 112 at that selected frequency for the next pumping cycle as represented by step 224. This selected $f_{BEF}$ is the best determined efficient frequency to run the pump 112 during normal flow operation. The process then ends.

If in step 210 or in step 223, the inflow is greater than or equal to the Discharge Flow which is indicative of a High inflow condition, a PID (Proportion, Integral, and Derivative) operation may be carried out as represented by step 226 to determine an optimal frequency to operate the pump. In general, the PID operation calculates an "error" value as the difference between a measured process variable and a desired setpoint. The controller attempts to minimize the error by adjusting the process control inputs. The PID controller calculation (algorithm) involves three separate constant parameters: the proportional, the integral, and derivative values denoted as P, I, and D. Heuristically, these values can be interpreted in terms of time: P depends on the present error, I on the accumulation of past errors, and D is a prediction of future errors, based on current rate of change. The weighted sum of these three actions is used to adjust the process via a control element. By tuning the three parameters in the PID controller algorithm, the controller can provide control action designed for specific process requirements. The response of the controller can be described in terms of the responsiveness of the controller to an error, the degree to which the controller overshoots the setpoint and the degree of system oscillation.

In step 226, the controller determines the control output signal (CO), which controls the frequency output of the variable frequency drive using the following PID equation:

$$CO = CO_{bias} + Kc \cdot e(t) + \frac{Kc}{Ti}\int e(t)dt + Kc \cdot Td\frac{de(t)}{dt}$$

where $CO_{bias}$=0 (not used) or other bias amount, e(t)=error which is defined as PV−SP, where the PV (Process Value) is defined as the tank level measurement and SP (Set Point) is defined as the (pump start level−pump stop level)/2 and, Kc=controller gain, Ti=reset time, a tuning parameter, and Td=derivative time=0 (not used) or other amount, For example, if PV=60 and SP=50, then e(t)=10. The error of 10 is then amplified by the gain constant Kc and added to the integral and derivative results calculated over a period of time (t). This total is the output of the PID equation or CO. As an example, an output of 80% would run the variable frequency drive at 80% of the maximum frequency. That is 60 Hz·0.8=48 Hz. In this High inflow condition, a minimum output frequency is set to prevent the pump from running at speeds lower than that recommended by the pump manufacturer. The minimum output frequency is at a value that results in a level drop when the inflow returns to normal.

After step 226, the controller 116 goes to step 228 and determines whether a normal inflow condition or High inflow condition is present. If the High inflow condition continues to be present, the PID operation is continued. If the inflow returns to normal, the PID will slow the pump 112 down to a minimum speed and shuts off the pump when the sewage level drops below the pump stop level as represented by step 230. The method may then return to step 204 to monitor when the liquid level goes above the pump start level.

In other examples, other ways of determining whether a normal inflow condition or High inflow condition may be used. For example, the change in sewage level may be monitored by the depth level sensor 114 to determine whether a normal inflow condition or High inflow condition is present. In particular, if the monitor level does drop within a predetermined time while the pump 112 is running, the controller 116 determines that a normal inflow condition is present. However, if the monitor level does not drop within a predetermined time while the pump 112 is running, the controller 116 determines that a High inflow condition is present. Also, in another example to find the $f_{BEF}$, the W/GPM value for the energy may be use in lieu of the W·h/Cycle. The W is the value measured and sent by the variable frequency drive to the controller as previously mentioned. GPM may be calculated using equation 4 (or other formula). All other steps may be the same as the previous example.

As used herein, the terms "component" and "system" are intended to encompass hardware, software, or a combination of hardware and software. Thus, for example, a system or component may be a process, a process executing on a processor, or a processor. Additionally, a component or system may be localized on a single device or distributed across several devices.

It is noted that several examples have been provided for purposes of explanation. These examples are not to be construed as limiting the hereto-appended claims. Additionally, it may be recognized that the examples provided herein may be permutated while still falling under the scope of the claims.

What is claimed is:

1. A system comprising:

a pump, wherein the pump includes a motor, wherein the pump is operative to move liquid out of a reservoir;

a depth level sensor, wherein the depth level sensor is operative to determine a depth level of the liquid in the reservoir;

at least one controller, wherein the at least one controller is operatively connected to the depth level sensor;

a variable frequency motor drive operatively connected to the motor and the controller, wherein the variable frequency motor drive is operative to control speed of the motor; and wherein responsive to the determined depth level of the liquid increasing to at least a first level, the at least one controller is operative to start operation of the motor, determine an optimal frequency outputted by the variable frequency motor drive that will cause the motor to operate with lowest energy usage to lower the depth level of the liquid in the reservoir from the first level to a lower second level, cause the variable frequency motor drive to output the optimal frequency to the motor to operate the motor with lowest energy usage, wherein the at least one controller is operative to determine the energy used by the motor during the operation of the pump in moving liquid out of the reservoir from the first level to the second level by subtracting the power consumption of the motor of the pump at the first level from the power consumption of the motor of the pump at the second level, wherein the at least one controller is operative to cause the variable frequency motor drive to output a lower frequency for each successive pump operation until the energy used by the motor for the last pump operation is greater than or equal to the energy used by the motor for the previous pump operation, wherein the at least one controller is operative to determine that the optimal frequency is the frequency outputted by the variable frequency motor drive for the last pump operation in which the energy used by the motor is greater than or equal to the energy used by the motor for the previous pump operation.

2. The system according to claim 1 wherein the at least one controller is operative to determine the optimal frequency only when the flow of liquid into the reservoir is less than the flow of liquid out of the reservoir during operation of the pump.

3. A method, comprising:

a) determining that liquid in a reservoir is at a first level using a depth level sensor positioned in the reservoir;

b) through operation of at least one controller, determining an optimal frequency outputted by a variable frequency drive that causes a pump to operate at the lowest usage of energy to move liquid out of the reservoir from the first level to a second lower level in response to the liquid being determined in a) at the first level, wherein b) further comprises:

i) operating the variable frequency drive to output a first frequency to control the speed of the motor of the pump as the pump operates to move liquid out of the reservoir from the first level to the second level;

ii) determining the energy outputted by the motor during i) by subtracting the power consumption of the motor of the pump at the first level from the power consumption of the motor of the pump at the second level;

iii) responsive to the liquid being at the first level again, operating the variable frequency drive to output a second frequency that is lower than the first frequency to control the speed of the motor of the pump as the pump operates to move the liquid out of the reservoir from the first level to the second lower level;

iv) determining the energy outputted by the motor during iii) by subtracting the power consumption of the motor of the pump at the first level from the power consumption of the motor of the pump at the second level;

v) comparing the energy outputted by the motor during i) with the energy outputted by the motor during iii)

vi) repeating i) to v) with the first frequency being set at a frequency that is lower than the second frequency for the last pump operation until the energy outputted by the motor during i) is less than the energy outputted by the motor during iii); and vii) subsequent to vi), determining that the first frequency outputted by the variable frequency drive used to cause the energy outputted by the motor during i) of the last pump operation is the optimal frequency and;

c) operating the variable frequency drive to output the optimal frequency to cause the motor of the pump to operate at the lowest usage of energy.

4. The method according claim 3 wherein i) to vii) is performed only when a flow of liquid into the reservoir is less than a flow of liquid out of the reservoir during operation of the pump.

5. A non-transient tangible computer-readable medium comprising instructions that, when executed by at least one processor, perform the following acts:

a) determining that liquid in a reservoir is at a first level using a depth level sensor positioned in the reservoir;

b) through operation of at least one controller, determining an optimal frequency outputted by a variable frequency drive that causes a pump to operate at the lowest usage of energy to move liquid out of the reservoir from the first level to a lower second level in response to the liquid being determined in a) at the first level, wherein in (b) the optimal frequency is determined by:

$$CO = Kc \cdot e(t) + \frac{Kc}{Ti}\int e(t)dt + Kc \cdot Td\left(\frac{de(t)}{dt}\right)$$

Where Kc =controller gain,

Ti =reset time,

Td =derivative time, e(t) =error which is defined as SP-PV, where SP is defined as the (pump start liquid level-pump stop liquid level)/2, and PV is defined as the reservoir level measurement; and c) operating the variable frequency drive to output the optimal frequency to cause the motor of the pump to operate at the lowest usage of energy, wherein b) is performed only when the flow of liquid into the reservoir is greater than or equal to the flow of liquid out of the reservoir during operation of the pump.

6. The method according to claim 3, wherein the at least one controller includes a processor, wherein the reservoir is a wastewater tank, wherein the liquid is wastewater.

7. The system according to claim 1, wherein the at least one controller includes a control component, wherein the depth level sensor includes a sensor component, wherein the sensor component is configured to output signals that are representative of the depth level of the liquid in the reservoir, wherein the control component is operatively connected to the sensor component, wherein the control component is configured to receive the signals from the sensor component representative of the depth level of the liquid in the reservoir, wherein the control component is configured to start operation of the motor in response to receiving a signal from the sensor component representative of the depth level of the liquid increasing to the at least first level.

8. The system according to claim 1, wherein the at least one controller includes a control component, wherein the depth level sensor includes a transmitter, wherein the transmitter is operatively connected to the control component through a signal cable, wherein the transmitter is configured to emit signals that are representative of the depth level of the liquid in the reservoir, wherein the control component is configured to receive the signals from the transmitter representative of the depth level of the liquid in the reservoir, wherein the control component is configured to start operation of the motor in response to receiving a signal from the transmitter representative of the depth level of the liquid increasing to the at least first level.

9. The system according to claim 1 including a housing, wherein the at least one controller and the variable frequency drive are housed in the housing.

10. A method, comprising:

a) determining that liquid in a reservoir is at a first level using a depth level sensor positioned in the reservoir;

b) through operation of at least one controller, determining an optimal frequency outputted by a variable frequency drive that causes a pump to operate at the lowest usage of energy to move liquid out of the reservoir from the first level to a second lower level in response to the liquid being determined in a) at the first level, wherein b) further comprises:

i) determining the flow of liquid out of the reservoir during operation of the pump;

ii) determining the flow of liquid into the reservoir;

iii) comparing the flow of liquid out of the reservoir during operation of the pump and the flow of liquid into the reservoir;

iv) if the flow liquid into the reservoir is less than the flow of liquid out of the reservoir during operation of the pump, then the optimal frequency is determined by:

1) operating the variable frequency drive to output a first frequency to control the speed of the motor of the pump as the pump operates to move liquid out of the reservoir from the first level to the second level;

2) determining the energy outputted by the motor during 1);

3) responsive to the liquid being at the first level again, operating the variable frequency drive to output a second frequency that is lower than the first frequency to control the speed of the motor of the pump as the pump operates to move the liquid out of the reservoir from the first level to the second lower level;

4) determining the energy outputted by the motor during 3);

5) comparing the energy outputted by the motor during 1) with the energy outputted by the motor during 3);

6) repeating 1) to 5) with the first frequency being set at a frequency that is lower than the second frequency for the last pump operation until the energy outputtted by the motor during 1) is less than the energy outputted by the motor during 3); and 7) subsequent to 6), determining that the first frequency outputted by the variable frequency drive used to cause the energy outputted by the motor during 1) of the last pump operation is the optimal frequency;

v) if the flow liquid into the reservoir is greater than or equal to the flow of liquid out of the reservoir during operation of the pump, then the optimal frequency is determined by:

$$CO = Kc \cdot e(t) + \frac{Kc}{Ti}\int e(t)dt + Kc \cdot Td\left(\frac{de(t)}{dt}\right)$$

Where Kc =controller gain,

Ti =reset time,

Td =derivative time, e(t) =error which is defined as SP-PV, where SP is defined as the (pump start liquid level-pump stop liquid level)/2, and PV is defined as the reservoir level measurement; and c) operating the variable frequency drive to output the optimal frequency to cause the motor of the pump to operate at the lowest usage of energy.

11. The method according to claim 10 wherein the energy outputted by the motor in 2) is determined by subtracting the power consumption of the motor of the pump at the first level from the power consumption of the motor of the pump at the second level, wherein the energy outputted by the motor in 4) is determined by subtracting the power consumption of the motor of the pump at the first level from the power consumption of the motor of the pump at the second level.

12. The method according to claim 3 wherein c) includes operating the variable frequency drive to output the optimal frequency to cause the motor of the pump to operate at the lowest usage of energy but at a frequency that is sufficient to prevent the pump from running at speeds lower than that recommended by the pump manufacturer.

13. The method according to claim 4 wherein b) includes prior to i) determining a fill time that the liquid rises from the second level to the first level, determining a displaced volume of liquid between the first level and the second level, determining the flow of liquid into the reservoir using the determined displaced volume of liquid and the fill time, determining a discharge time that the liquid moves out of the reservoir from the first level to the second level during operation of the pump, and determining the flow of liquid out of the reservoir as the pump operates to move liquid out of the reservoir from the first level to the second level using the determined displaced volume of liquid and the discharge time.

* * * * *